US006045410A

United States Patent [19]

Norizuki et al.

[11] Patent Number: 6,045,410

[45] Date of Patent: Apr. 4, 2000

[54] CONNECTOR

[75] Inventors: Teruhisa Norizuki; Shinji Kodama, both of Shizuoka, Japan

[73] Assignee: Yazaki Corporation, Tokyo, Japan

[21] Appl. No.: 09/272,323

[22] Filed: Mar. 19, 1999

[30] Foreign Application Priority Data

Mar. 20, 1998 [JP] Japan ..... 10-072857

[51] Int. Cl.[7] ..... H01R 13/502

[52] U.S. Cl. ..... 439/701; 439/686

[58] Field of Search ..... 439/310, 342, 439/352, 489, 701, 707, 903, 686

[56] References Cited

U.S. PATENT DOCUMENTS

| | | | |
|---|---|---|---|
| 5,312,268 | 5/1994 | Sumida | 439/701 |
| 5,564,453 | 10/1996 | Endo et al. | 439/701 |
| 5,957,732 | 9/1999 | Ito et al. | 439/701 |

*Primary Examiner*—Hien Wu
*Attorney, Agent, or Firm*—Sughrue, Mion, Zinn, Macpeak & Seas, PLLC

[57] ABSTRACT

A cover is formed in a size which completely envelops one connector housing in a state of waiting for engagement, and a guide groove is provided on an inner wall of the cover. A flexible arm is provided on the inner wall of the cover and has a retaining portion at a distal end thereof for temporarily retaining the one connector housing in the state of waiting for engagement inside the cover. A stopper projection is provided in the one connector housing at a position opposing the guide groove for sliding in the guide groove, and another stopper projection is provided in the one connector housing at a position opposing the retaining portion of the flexible arm, the other stopper projection being temporarily retained by the retaining portion of the flexible arm. Tapered surfaces are respectively provided on the retaining portion of the flexible arm and the other stopper projection at mutually opposing positions thereof, the tapered surfaces being arranged to retain each other.

3 Claims, 14 Drawing Sheets

CONNECTOR

BACKGROUND OF THE INVENTION

1. Field of the Invention

The present invention relates to a connector in which male and female connector housings of the multi-pole type can be fitted together and disconnected from each other.

The present application is based on Japanese Patent Application No. Hei. 10-72857, which is incorporated herein by reference.

2. Description of the Related Art

An example of a connector of the above-described type will be briefly described with reference to FIGS. 19 and 20. A slide cover 3 is fitted over a synthetic resin-made male connector housing 2 in such a manner as to be reciprocatingly slidable. Proximal end portions 4*a* of a pair of levers 4, which are rotated by the reciprocating motion of the slide cover 3, are respectively supported rotatably on both sides of an upper wall portion of the slide cover 3 through a pair of supporting shafts 3*a* serving as points of force application. An intermediate portion 4*b* of each of these levers 4 is linked to a guide portion (a point of action) 5 on either side of the male connector housing 2, and a distal end 4*c* of each lever 4 is arranged to be engageable with a rib (engaging portion) of a synthetic resin-made female connector housing 7 when the male and female connector housings 2 and 7 are engaged.

In addition, as shown in FIG. 20, the slide cover 3 is formed in a rectangular cylindrical shape so as to be fitted over the male connector housing 2, and a pair of extending portions 3*b* for enveloping both side portions of the male connector housing 2 are respectively formed projectingly from their side wall portions. As a result, front-side central portions of upper and lower wall portions of the slide cover are cut out in rectangular shapes (these cutout portions are denoted by reference numeral 3*c* in FIG. 20).

As shown in FIG. 19, a temporarily retained state in which each lever 4 is tilted between a projection 5*a* of the guide portion 5 and a tapered surface 6*a* of a lever pushing portion 6 of the male connector housing 2 is a state of waiting for engagement of the male connector housing 2 in the slide cover 3 (a so-called state of waiting for reception). If the slide cover 3 by which the male connector housing 2 is temporarily retained is pushed into a hood portion 7*a* of the female connector housing 7 in this state, the distal end of the lever 4 abuts against a projection 8*a* (serving as a fulcrum of the lever) of the rib 8 of the hood portion 7*a* of the female connector housing 7, and the lever 4 starts to rotate. If the slide cover 3 is further pushed in the engaging direction, the male connector housing 2 is pulled into the hood portion 7*a* of the female connector housing 7 through the leverage of the lever 4 (the action of the lever in which the supporting shaft 3*a* for rotatably supporting the proximal end portion 4*a* of the lever 4 serves as the point of force application, the projection 5*a* of the guide portion 5 of the male connector housing 2 serves as the point of application, and the projection 8*a* of the rib 8 of the female connector housing 7 serves as the fulcrum), thereby allowing the two connector housings 2 and 7 to engage each other.

However, in the connector 1, since each lever 4, which is rotatably supported by the supporting shaft 3*a* of the slide cover, is tilted between the projection 5*a* of the guide portion 5 and the tapered surface 6*a* of the lever pushing portion 6 of the male connector housing 2, the state of waiting for engagement of the male connector housing 2 in the slide cover 3 is temporarily secured. Therefore, the force with which the male connector housing 2 is temporarily retained and held in the slide cover 3 is weak, so that there has been a possibility that the male connector housing 2 is undesirably retracted in the rearward direction within the slide cover 3 before completion of the engagement between the two connector housings 2 and 7, making it impossible to engage the two connector housings 2 and 7. In addition, since the slide cover 3 is not provided with a guide with respect to the back-and-forth movement of the male connector housing 2, the male connector housing 2 is liable to assume a state of being tilted diagonally downward in the slide cover 3, so that there has been a possibility of the occurrence of faulty engagement or incomplete engagement between the two connector housings 2 and 7.

SUMMARY OF THE INVENTION

In order to eliminate the above-described problems, it is an object of the present invention to provide a connector which is able to allow two connector housings to be easily and reliably engaged with each other by improving the force with which one connector housing is temporarily retained and held in the cover until the completion of engagement between the male and female connector housings.

In accordance with the present invention, there is provided a connector which comprises a male connector housing and a female connector housing one of which is provided in a cover in such a manner as to be reciprocatingly slidable, a lever rotatably supported by the cover and having a proximal end portion which is rotated by the reciprocal motion of the one connector housing, an intermediate portion of the lever being linked to a point of action portion of the one connector housing, a distal end portion of the lever being engageable with an engaging portion of another connector housing when the two connector housings are engaged with each other, the cover being formed in a size which completely envelops the one connector housing in a state of waiting for engagement, a guide groove provided on an inner wall of the cover, a flexible arm provided on the inner wall of the cover and having a retaining portion at a distal end thereof for temporarily retaining the one connector housing in the state of waiting for engagement inside the cover, a stopper projection provided in the one connector housing at a position opposing the guide groove for sliding in the guide groove, another stopper projection provided in the one connector housing at a position opposing the retaining portion of the flexible arm, the other stopper projection being temporarily retained by the retaining portion of the flexible arm, and tapered surfaces respectively provided on the retaining portion of the flexible arm and the other stopper projection at mutually opposing positions thereof, the tapered surfaces being arranged to retain each other.

In this connector, it is possible to sufficiently secure the force with which one connector housing is temporarily retained and held in the cover until the completion of engagement between the male and female connector housings by virtue of the guide groove of the cover and the retaining portion of the flexible arm and the respective stopper projections of one connector housing. As a result, the coming off of the cover and one connector housing due to an external load force and the diagonally downward tilting of one connector housing inside the cover are reliably prevented, and the faulty engagement or incomplete engagement between the two connector housings is prevented, making it possible to engage the two connector housings with each other easily and reliably.

The above and other objects, features and advantages of the present invention will become more apparent from the following detailed description of the invention when read in conjunction with the accompanying drawings.

DETAILED DESCRIPTION OF THE PREFERRED EMBODIMENTS

Figure 1:
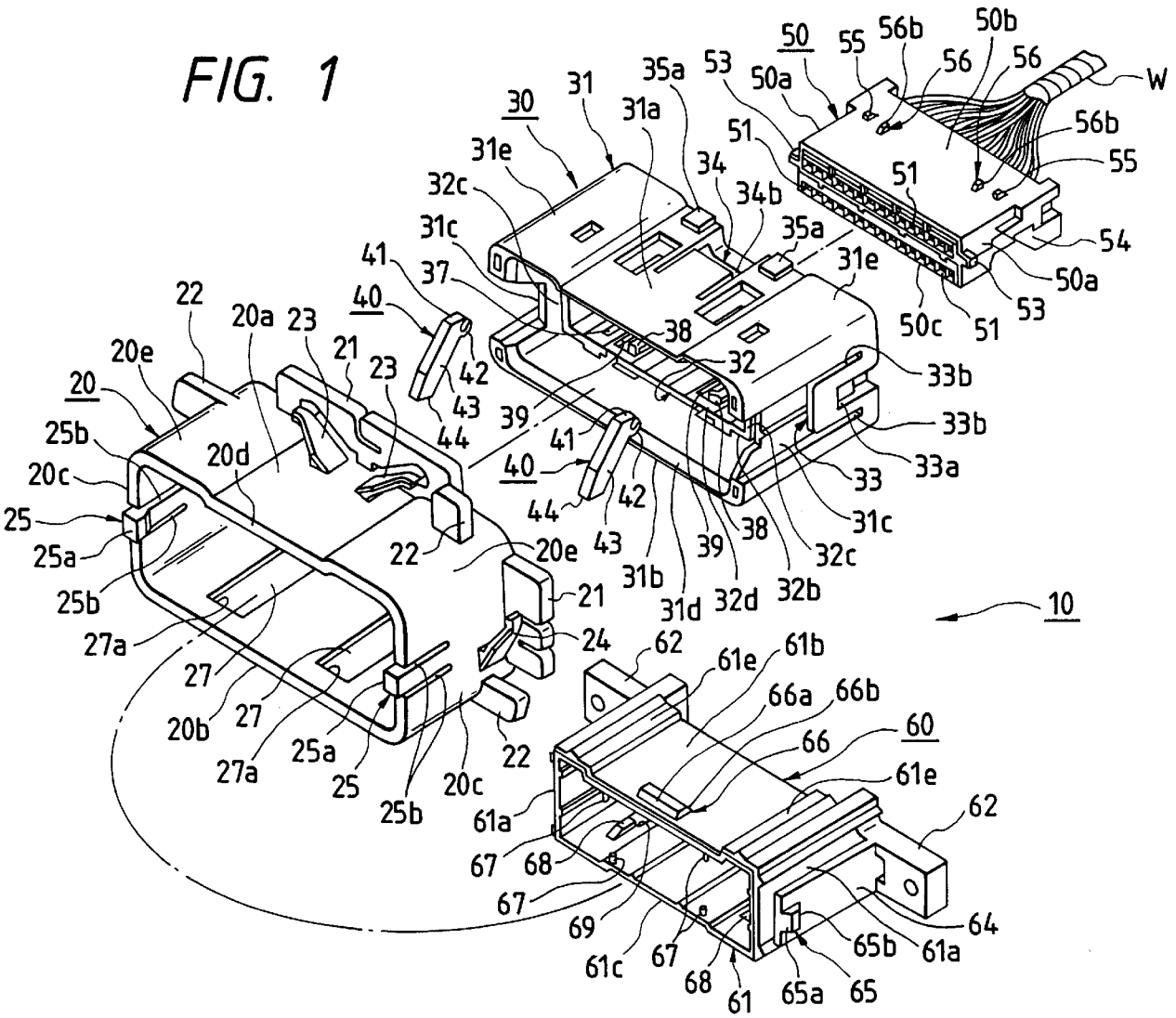
FIG. 1 is an exploded perspective view of a connector in accordance with an embodiment of the present invention.
Figure 2:
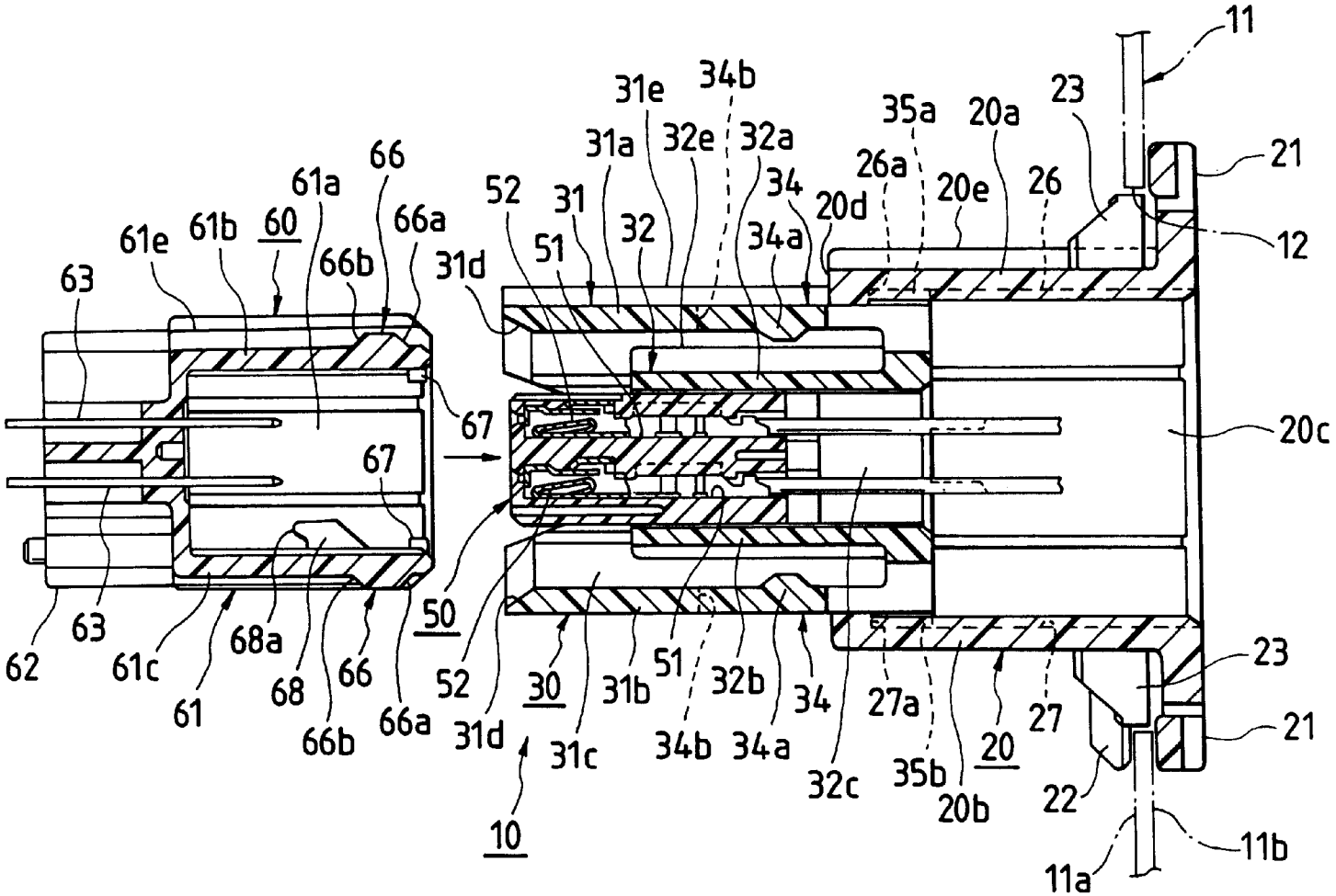
FIG. 2 is a longitudinal sectional view illustrating a state before the engagement of the connector.
Figure 3:
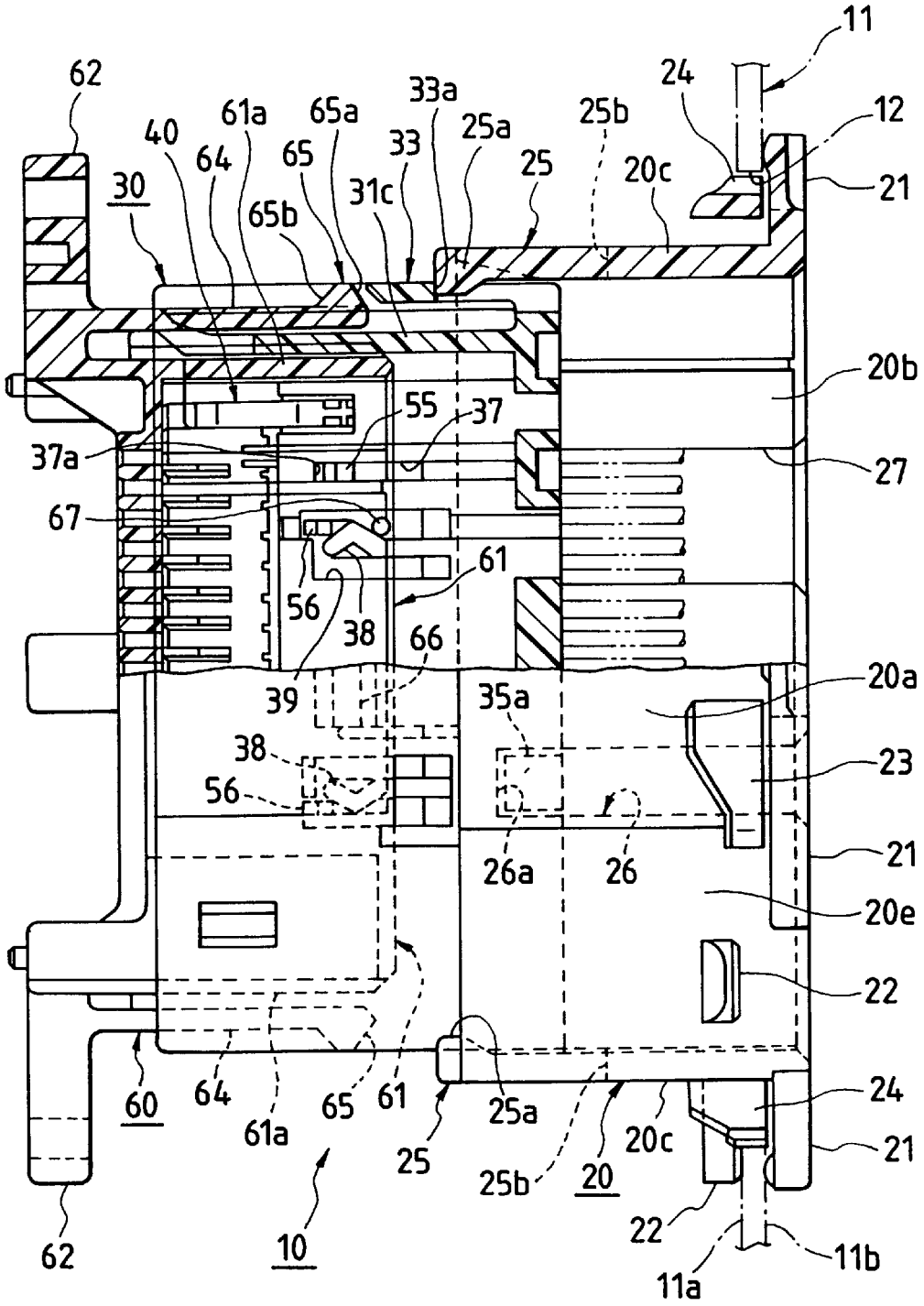
FIG. 3 is a plan view, partly in section, illustrating a state immediately before the engagement of the connector.

An embodiment of the present invention will be described below with reference to FIGS. 1 to 18. FIG. 1 is an exploded perspective view illustrating a connector in accordance with an embodiment of the present invention, FIG. 2 is a longitudinal sectional view illustrating a state before the engagement of the connector, and FIG. 3 is a plan view, partly in section, illustrating a state immediately before the engagement of the connector. It should be noted that, in the description of the drawings, the engaging sides of male and female connector housings which make up the connector will be respectively set as front sides.

As shown in FIGS. 1 to 3, a connector 10 comprises a substantially rectangular cylindrical holder 20 made of a synthetic resin and mounted in a substantially rectangular mounting hole 12 in an inner panel (a member to be attached to) 11 of a vehicle; a substantially rectangular cylindrical cover 30 which is made of a synthetic resin, is temporarily retained in this holder 20 in an accommodated state, and is provided slidably in its back-and-forth direction; a pair of levers 40 which are made of a synthetic resin, whose proximal end portions 41 are rotatably supported by the cover 30, and which allow male and female connector housings 50 and 60, which will be described later, to be engaged with each other through leverage; the male connector housing (one connector housing) 50 which is made of a synthetic resin, is temporarily retained in the upper cover 30 is a state of waiting for engagement in the cover 30 (a so-called state of waiting for reception), and is provided in such a manner as to be reciprocatingly slidable inside the cover 30; and the female connector housing (the other connector housing) 60 which is made of a synthetic resin, and is engaged with or disengaged from the male connector housing 50 in the state of waiting for engagement.

As shown in FIGS. 1 to 4, the holder 20 is formed in a shape of a substantially rectangular cylinder by upper and lower walls 20*a* and 20*b* and a pair of opposite side walls 20*c*, and the cover 30 is slidably supported in the holder 20. A rear-side fixing plate portion 21, which is retained at a rear surface 11b of the inner panel 11, is integrally formed projectingly in a center portion of a rear end of each wall 20*a*, 20*b*, and 20*c* of the holder 20 at its rear opening. Also, a front-side fixing plate portion 22, which is retained at a front surface 11*a* of the inner panel 11, is integrally formed projectingly at a forward position spaced apart from the rear-side fixing plate portion 21 by the portion of the thickness of the inner panel 11 at a position close to each corner of a rear portion of each wall 20*a*, 20*b*, and 20*c*. Further, pairs of aligning spring portions 23 and aligning spring portions 24 are respectively formed projectingly at central portions of the rear portions of the upper and lower walls 20*a* and 20*b* and the side walls 20*c* of the holder 20 at positions opposing inner edges of the mounting hole 12.

Further, as shown in FIGS. 1 to 4, a front end portion (an engaging-side end portion of the female connector housing 60) 20*d* at a front-side opening of each of the walls 20*a*, 20*b*, and 20*c* of the holder 20 is formed as a vertical surface. In addition, an L-shaped flexible arm (temporarily retaining means) 25 is formed integrally through a pair of slits 25*b* in such a manner as to extend from the center toward the front side of the central portion of each side wall 20*c* of the holder 20. As shown in FIGS. 1 and 3, a projection (retaining portion) 25*a* of a trapezoidal cross section is integrally formed projectingly on the inner side of the distal end of each of these flexible arms 25.

Further, a pair of narrow guide grooves 26 are integrally formed on both sides of the center on the inner surface side of the upper wall 20*a* of the holder 20, while a pair of wide guide grooves 27 are integrally formed on both sides of the center on the inner surface side of the lower wall 20*b* of the holder 20. These guide grooves 26 and 27 are recessed in the form of guide rails on the inner surface side, and front wall portions 26*a* and 27*a* which are in a stepped state with respect to the inner surface of each front end side serve as stoppers for the cover 30.

Figure 9:
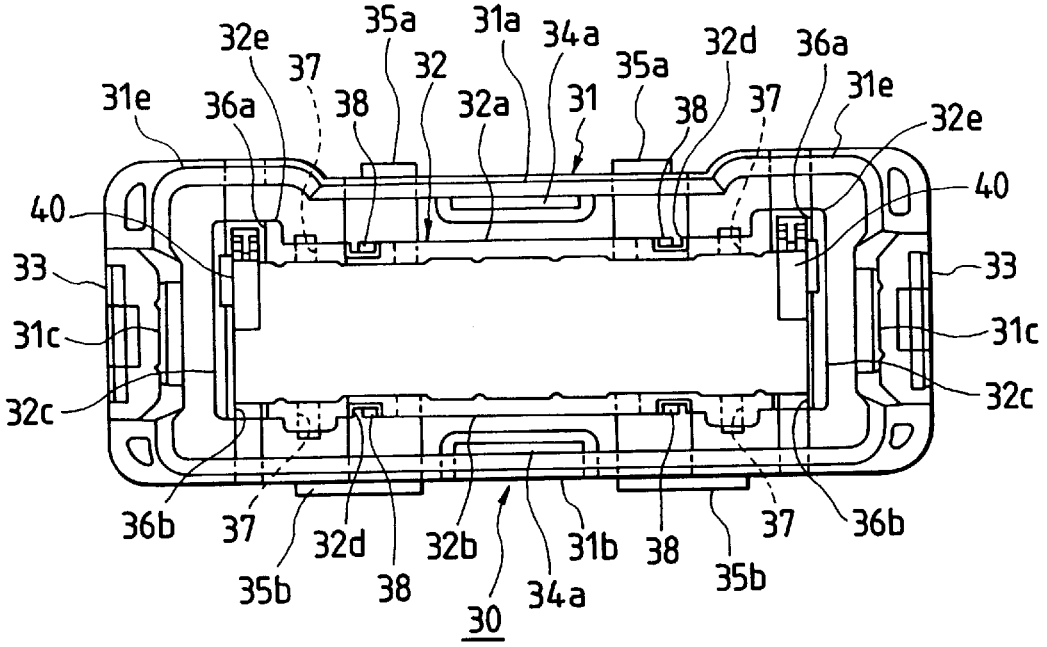
FIG. 9 is a front elevational view of a cover used in the connector.
Figure 10:
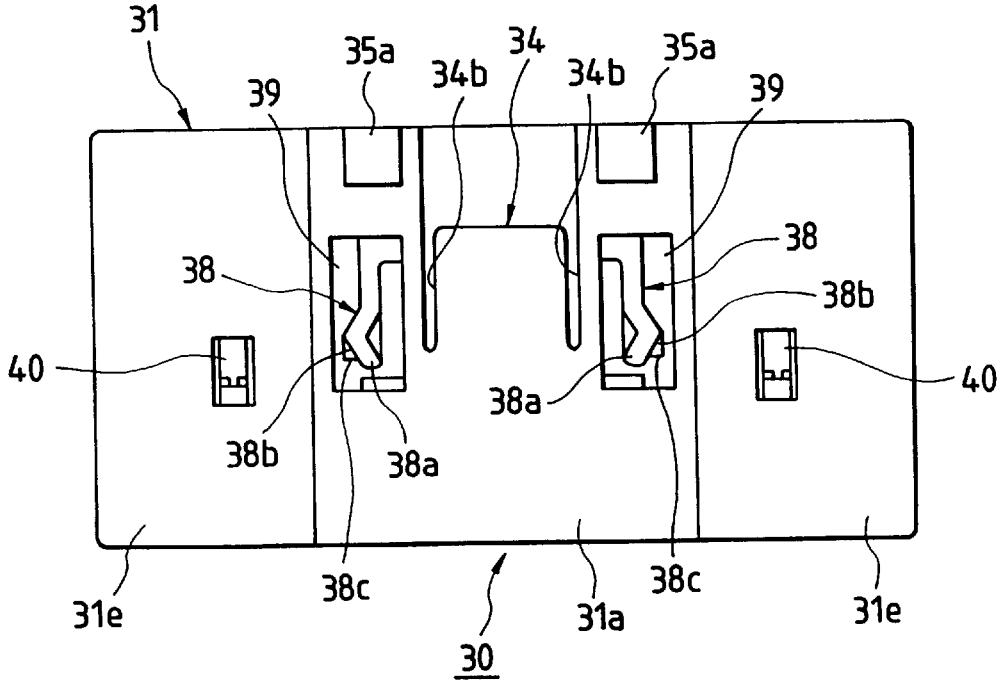
FIG. 10 is a plan view of the cover.

As shown in FIGS. 1 and 9, the cover 30 has a double structure comprising a substantially rectangular cylindrical outer wall 31 and a substantially rectangular cylindrical inner wall 32 formed integrally with the outer wall 31. A hood portion 61 of the female connector housing, which will be described later, is accommodated in the cover 30 between the outer wall 31 and the inner wall 32 with the front sides open, and the male connector housing 50 is temporarily retained slidably within the inner wall 32 in the state of waiting for engagement. Namely, as shown in FIG. 2, the outer wall 31 of the cover 30 is formed in a size which completely envelops the male connector housing 50 in the state of waiting for engagement, and tapered surfaces 31*d* for guiding for the engagement of the female connector housing 60 are formed on front end portions (engaging-side end portions of the female connector housing 60) at the front-side opening of upper and lower wall portions 31*a* and 31*b* of the outer wall 31.

Figure 7:
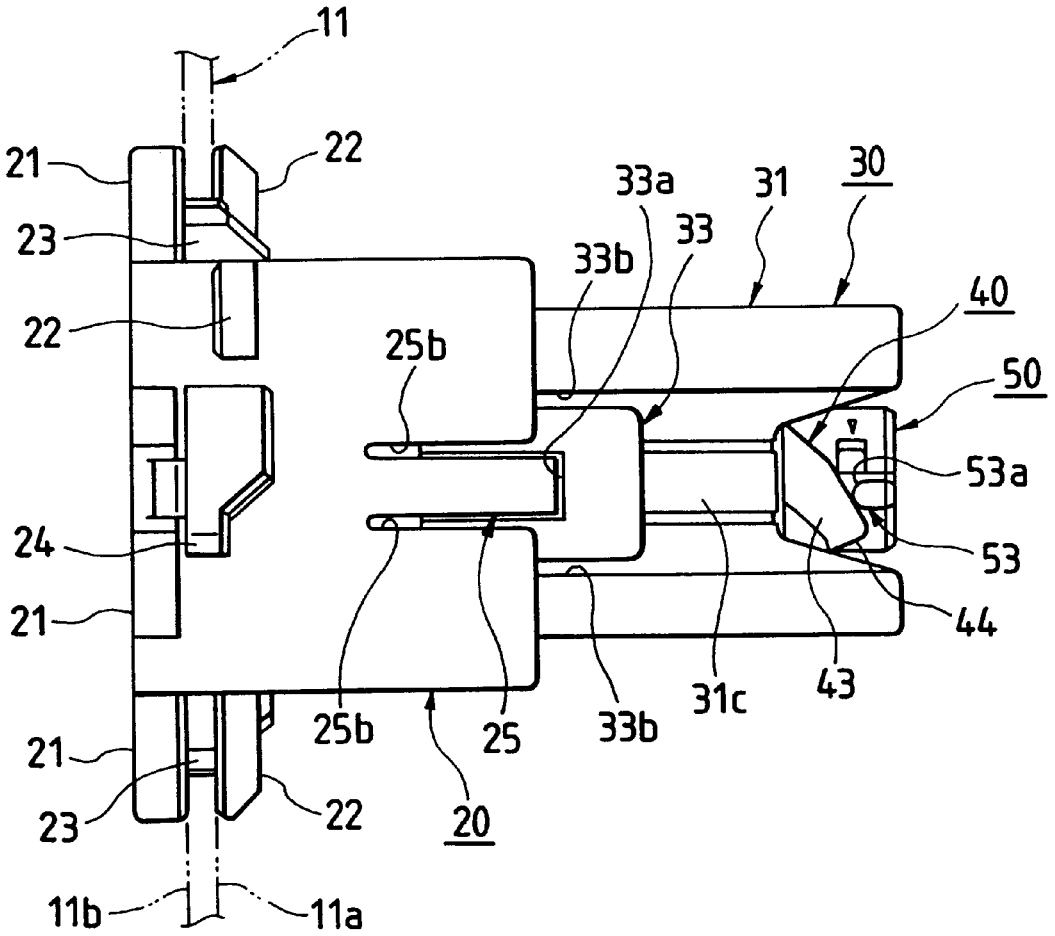
FIG. 7 is a left side view of the male connector housing.
Figure 8:
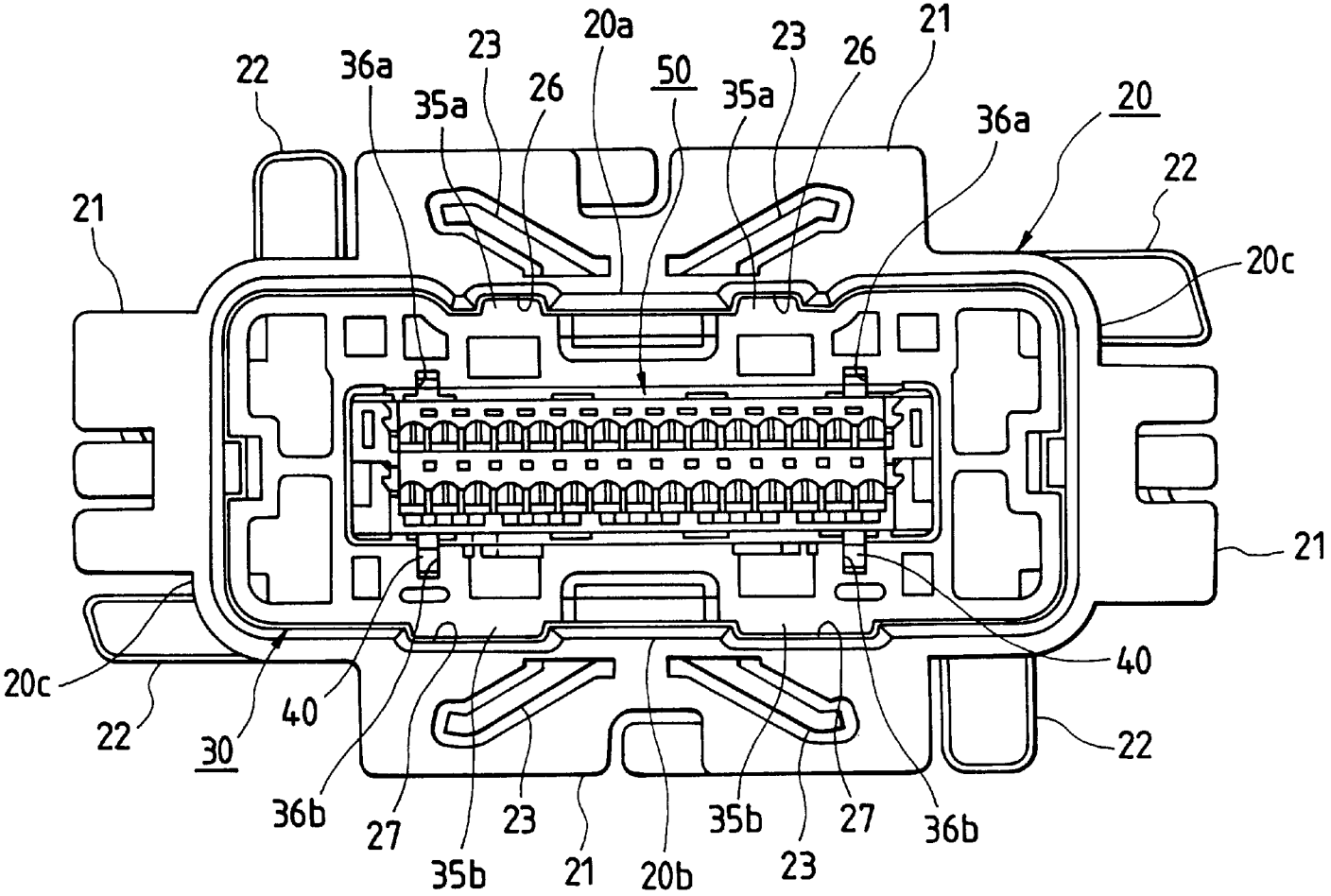
FIG. 8 is a rear view of the male connector housing.

In addition, as shown in FIGS. 1 and 7, pairs of slits 33*b* are respectively formed at rear-side central portions of side wall portions 31*c* of the outer wall 31 of the cover 30, and substantially U-shaped flexible retaining pieces (temporarily retaining means) 33 having rectangular engaging holes (engaging portions), which are engaged with or disengaged from the projections 25*a* of the flexible arms 25 of the holder 20, are respectively formed integrally between each pair of slits 33*b*. The width of each flexible retaining piece 33 is set to be larger than the width of the projection 25*a* of each flexible arm 25, and each flexible retaining piece 33 is capable of abutting against each side wall 20*c* of the holder 20 in the vicinity of each flexible arm 25.

Further, as shown in FIGS. 1 and 2, a stopper arm (stopper means) 34 having a projection 34*a* on its inner surface is formed integrally on a rear-side central portion of each of the upper and lower wall portions 31*a* and 31*b* of the outer wall 31 of the cover 30 through a U-shaped slit 34*b*. In addition, as shown in FIGS. 1, 2, 6, and 8, pairs of stopper projections 35*a* and 35*b* are respectively integrally formed projectingly on the rear sides of the outer surfaces of the upper and lower walls 31*a* and 31*b* of the outer wall 31 of the cover 30 at positions opposing the pairs of guide grooves 26 and 27 of the holder 20. The state in which the stopper projections 35*a* and 35*b* are retained in abutment against the front wall portions 26*a* and 27*a* of the guide grooves 26 and 27 of the holder 20 is the state of waiting for engagement of the male connector housing 50.

As shown in FIGS. 1 and 2, the front end side of the inner wall 32 of the cover 30 is arranged to be located further inward than the outer wall 31 so as to allow the front side of the male connector housing 50 in the state of waiting for engagement to be exposed inside the outer wall 31. As shown in FIG. 9, pairs of lever escaping grooves 36*a* and 36*b* are respectively formed on both end ends of upper and lower wall portions 32*a* and 32*b* of the inner wall 32 of the cover 30, and the levers 40 are respectively disposed between the pairs of lever escaping grooves 36*a* and 36*b*. Further, pairs of guide grooves 37 in the form of rectangular holes are respectively formed on both sides of the upper and lower wall portions 32*a* and 32*b* of the inner wall 32 of the cover 30. Further, pairs of flexible arms (temporarily retaining means) 38 for allowing the male connector housing 50 in the state of waiting for engagement to be temporarily retained inside the inner wall 32 are integrally formed on the further inward side than the guide grooves 37 of the upper and lower wall portions 32*a* and 32*b* of the inner wall 32 of the cover 30 through substantially U-shaped slits 39.

Each of these flexible arms 38 has a chevron-shaped retaining portion 38*a* at its distal end, and a reversely tapered surface (tapered surface) 38*c* is integrally formed projectingly on the lower side of a tapered surface 38*b* on the outer side of the retaining portion 38*a*. The reversely tapered surface 38*c* of the retaining portion 38*a* of each flexible arm 38 is arranged to be temporarily retained by a tapered surface 56*b* on the rear side of each of other stopper projections 56 (which will be described later) of the male connector housing 50 when the male connector housing 50 is in the state of waiting for engagement. Meanwhile, the upper side of the tapered surface 38*b* of the retaining portion 38*a* of each flexible arm 38 is arranged to be pressed by a temporary-retention canceling projection 67 of the female connector housing 60, which will be described later. As a result, each flexible arm 38 undergoes deflectional deformation in the inward direction (in the direction indicated by the arrow in FIG. 11A), thereby cancelling the state of the temporary retention between the reversely tapered surface 38*c* of the retaining portion 38*a* of the flexible arm 38 and the tapered surface 56*b* on the rear side of the other stopper projection 56 of the male connector housing 50.

Figure 5:
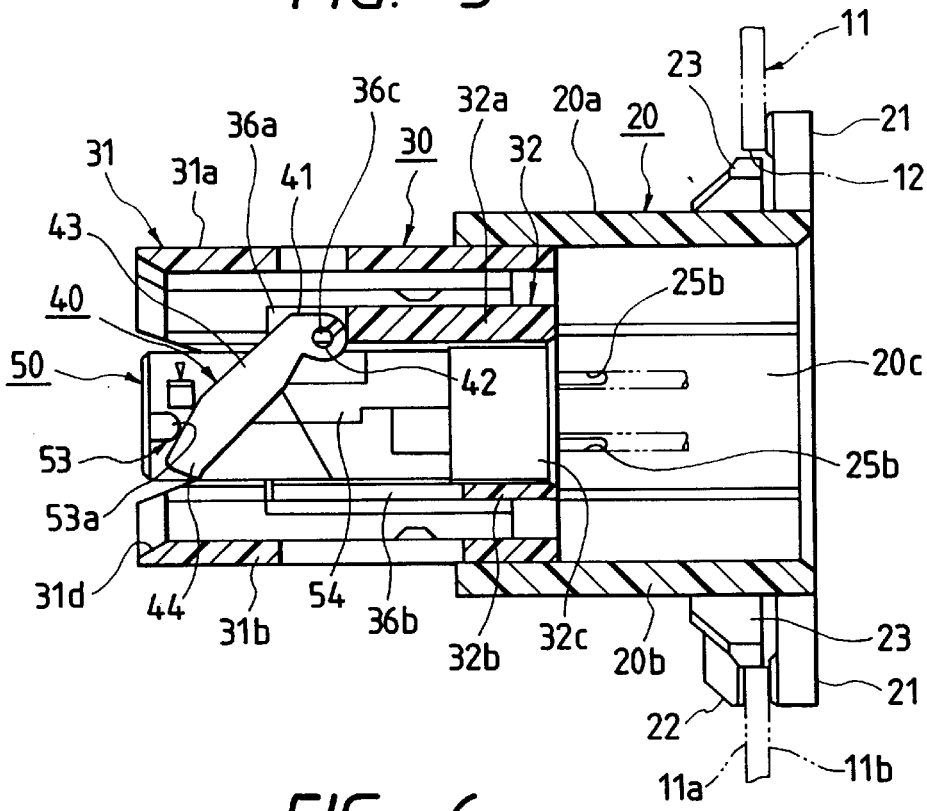
FIG. 5 is a cross-sectional view taken along line X—X in FIG. 4.

As shown in FIGS. 1 and 5, each lever 40 is formed in the form of a substantially rectangular plate, and a pivotally supporting hole 42 is formed in the center of its circular arc-shaped proximal end portion 41. The proximal end portion 41 of the lever 40 is rotatably supported as the supporting shaft 36*c* projecting inside each lever escaping groove 36*a* on the upper wall portion 32*a* side of the inner wall 32 of the cover 30 is fitted in this pivotally supporting hole 42, as shown in FIG. 5.

As shown in FIGS. 1 and 2, the male connector housing 50 is formed of a synthetic resin in the shape of a substantially rectangular parallelepiped, and a plurality of terminal accommodating chambers 51 are respectively formed in such a manner as to extend between its front and rear surfaces. Respectively accommodated in these terminal accommodating chambers 51 are female terminals (terminals) 52 which are electrically connected to male terminals 63 of the female connector housing 60, which will be described later, at the time of engagement between the two connector housings 50 and 60 so as to establish electric conduction between the two connector housings 50 and 60. A wire harness W shown in FIG. 1 is connected to the female terminals 52.

A guide portion (a point of action portion) 53 in the shape of a substantially rectangular parallelepiped and serving as a lever hooking portion is formed projectingly on the front-side center of each of side wall surfaces 50*a* of the male connector housing 50. A circular arc-shaped surface 53*a* on which an intermediate portion 43 of the lever 40 slides and which serves as a point of application for the lever 40 is formed on the rear side of each guide portion 53. Further, a substantially trapezoidal lever pushing portion 54, on which the intermediate portion 43 of the lever 40 slides in abutment therewith when the male connector housing 50 is in the state of waiting for engagement, is integrally formed projectingly at the center of each side surface 50*a* of the male connector housing 50.

Further, stopper projections 55 which slide in the respective guide grooves 37 are respectively integrally formed projectingly on both sides of upper and lower surfaces 50*b* and 50*c* of the male connector housing 50 at positions opposing the guide grooves 37 of the inner wall 32 of the cover 30. At the same time, other stopper projections 56 which are temporarily retained by the retaining portions 38 of the flexible arms 38 are respectively integrally formed projectingly on the upper and lower surfaces 50*b* and 50*c* of the male connector housing 50 at positions opposing the flexible arms 38 of the inner wall 32 of the cover 30.

Figure 6:
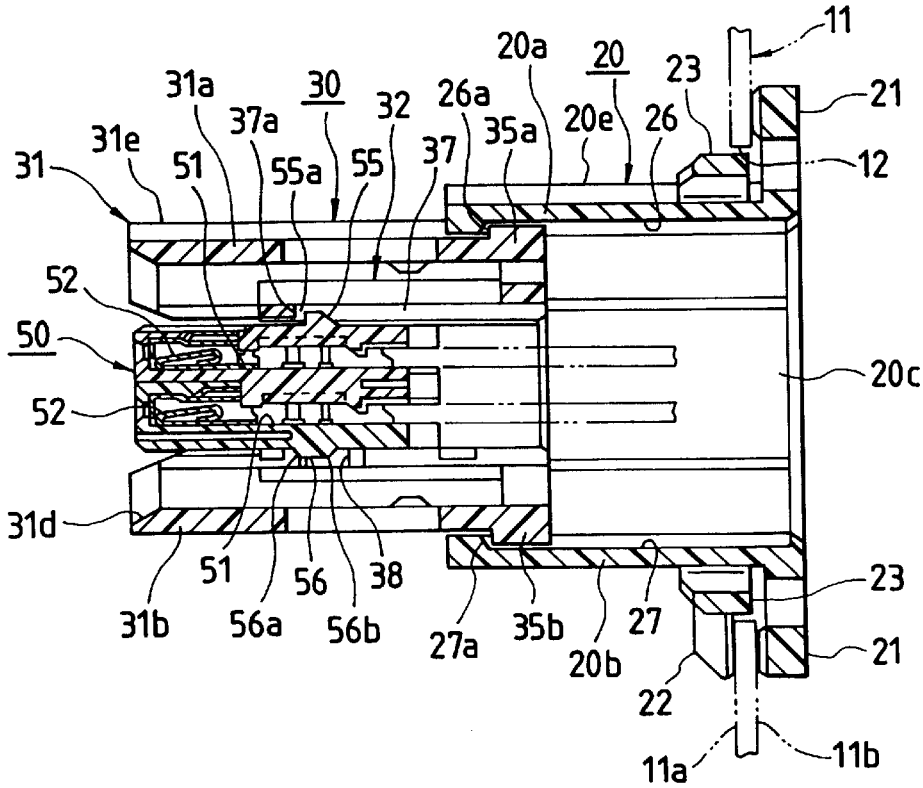
FIG. 6 is a cross-sectional view taken along line Y—Y in FIG. 4.
Figure 11A:
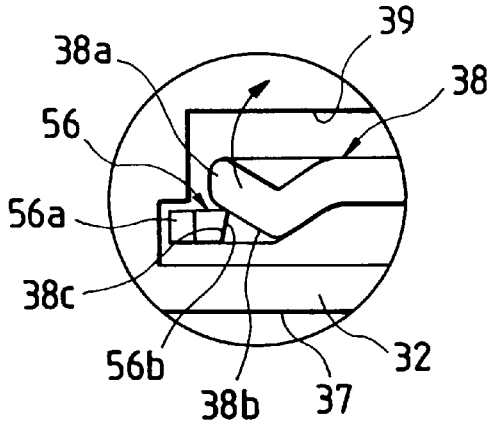
FIG. 11A is an explanatory plan view illustrating a temporarily retained state of an essential portion of the connector.
Figure 11B:
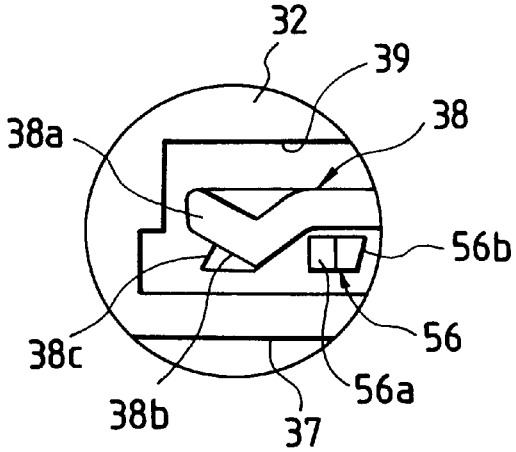
FIG. 11B is an explanatory plan view illustrating a fully retained state of the essential portion of the connector.

As shown in FIG. 6, as a vertical front face 55*a* of one stopper projection 55 is cause to abut against and is retained by a front wall portion 37*a* of each guide groove 37 of the inner wall 32 of the cover 30, the forward sliding o the male connector housing 50 is restricted. Meanwhile, as shown in FIGS. 11A and 11B, a vertically inclined front-side tapered surface 56*a* is formed on the front side of the other stopper projection 56, and a transversely inclined rear-side tapered surface 56*b* for abutment and retention is formed on the rear side of the other stopper projection 56 at a position opposing the reversely tapered surface 38*c* of the retaining portion 38*a* of each flexible arm 38 of the cover 30.

As shown in FIGS. 1 to 3, the plurality of male terminals (terminals) 63 are exposed inside the rectangular cylindrical hood portion 61 and between a pair of L-shaped leg portions 62 in the female connector housing 60. The arrangement provided is such that the hood portion 61 is inserted between the outer wall 31 and the inner wall 32 of the cover 30 at the time of engagement between the two connector housings 50 and 60 to allow the terminals 52 and 63 of the two connector housings 50 and 60 to be electrically connected to each other.

As shown in FIGS. 1 and 3, a pair of flexible arms 64 formed in the shape of rectangular plates are respectively integrally formed projectingly on the two leg portions 62 of the female connector housing 60 in such a manner as to be parallel with side walls 61*a* of the hood portion 61. A pair of projections (temporary-retention maintaining and canceling means) 65 are integrally formed projectingly at outer distal ends of the flexible arms 64. These projections 65 serve as both maintaining means for maintaining the state of temporary retention of the projection 25*a* of each flexible arm 25 of the holder 20 with respect to the engaging hole 33*a* of each flexible retaining piece 33 of the cover 30 and canceling means for cancelling the state of temporary retention of the projection 25*a* of each flexible arm 25 of the holder 20 with respect to the engaging hole 33*a* of each flexible retaining piece 33 of the cover 30 upon completion of engagement and disengagement of the two connector housings 50 and 60. Each of these projections 65 is formed in the shape of a substantially triangular prism, and its front side is formed as a tapered surface (engaging surface) 65*a*, and its rear side is formed as a similarly tapered surface (disengaging surface) 65*b*.

In addition, as shown in FIGS. 1, 2, 13, and 14, a pair of projections (temporary-retention maintaining and canceling means) 66 are respectively integrally formed projectingly at the center of a front side of an outer surface of each of upper and lower walls 61*b* and 61*c* of the hood portion 61 of the female connector housing 60. These projections 66 are adapted to maintain the state of temporary retention of the cover 30 in the holder 20 by deflecting and deforming each stopper arm 34 in the outward direction through the inner-side projection 34*a* of each stopper arm 34 of the cover 30 at the time of engagement between the two connector housings 50 and 60, and to cancel the state of temporary retention of the cover 30 in the holder 20 by riding over the projection 34*a* of each stopper arm 34 of the cover 30 upon completion of engagement and disengagement of the two connector housings 50 and 60. Each of these projections 66 is formed in the shape of a substantially triangular prism, and its front side is formed as a tapered surface (engaging surface) 66*a*, and its rear side is formed as a similarly tapered surface (disengaging surface) 66*b*.

Figure 11C:
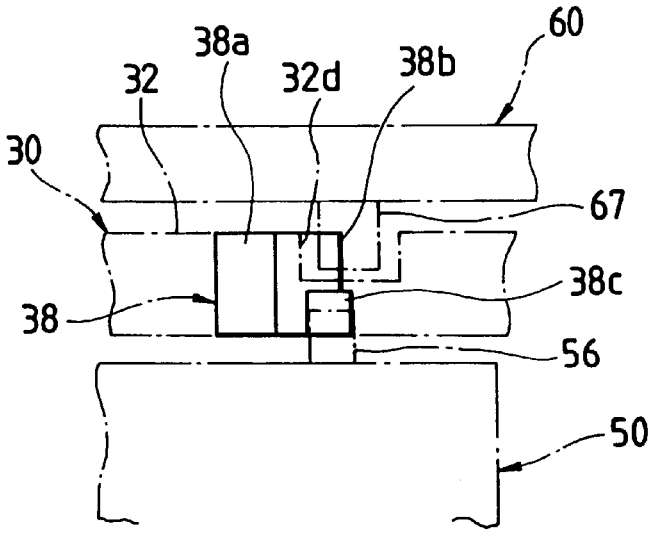
FIG. 11C is an explanatory plan view illustrating the temporarily retained state and the fully retained state of the essential portion of the connector.

Further, as shown in FIGS. 1, 3, and 11C, the temporary-retention canceling projection (temporary-retention canceling means) 67, which is formed in the shape of a circular cylinder and is arranged to be brought into contact with and move away from the tapered surface 38*b* of the retaining portion 38*a* of each flexible arm 38, is integrally formed projectingly at a front end on the inner surface of each of the upper and lower surfaces 61*b* and 61*c* of the hood portion 61 of the female connector housing 60 at a position opposing the retaining portion 38*a* of each flexible arm 38 of the cover 30.

In addition, as shown in FIGS. 1 and 2, a pair of ribs (engaging portion) 68 are respectively integrally formed projectingly on both sides at the front of the inner surface of the lower wall 61*c* of the hood portion 61 of the female connector housing 60. A projection 68*a*, on which a distal end portion 44 of the lever 40 slides, is integrally formed projectingly on an upper end of a rear surface of each of these ribs 68. Each of these projections 68*a* serves as a fulcrum for the lever 40 as the distal end portion 44 of the lever 40 is brought into sliding contact therewith when the hood portion 61 of the female connector housing 60 is slidingly inserted between the outer wall 31 and the inner wall 32 of the cover 30 and the female connector housing 60 is thereby pulled into the male connector housing 50 so as to allow the two connector housings 50 and 60 to be engaged with each other. Further, the lever escaping groove 69 is formed in the rear of each rib 68 of the lower wall 61*c* of the hood portion 61.

Incidentally, as shown in FIGS. 9 and 11C, recessed portions 32*d*, through which the projections 67 are respectively passed through, are respectively formed at front end portions of the upper and lower wall portion 32*a* and 32*b* of the inner wall 32 of the cover 30 at positions opposing the temporary-retention canceling projections 67 of the hood portion 61 of the female connector housing 60. Further, as shown in FIGS. 1 and 4, both sides of the upper wall 20*a* of the holder 20 are formed as protruding portions 20*e* which protrude upwardly, and protruding portions 31*e*, 32*e*, and 61*e* which protrude upwardly are respectively formed on upper walls of the outer wall 31 and the inner wall 32 of the cover 30 as well as the upper wall of the hood portion 61 of the female connector housing 60, which respectively oppose the protruding portions 20*e*, thereby preventing erroneous assembly.

Figure 4:
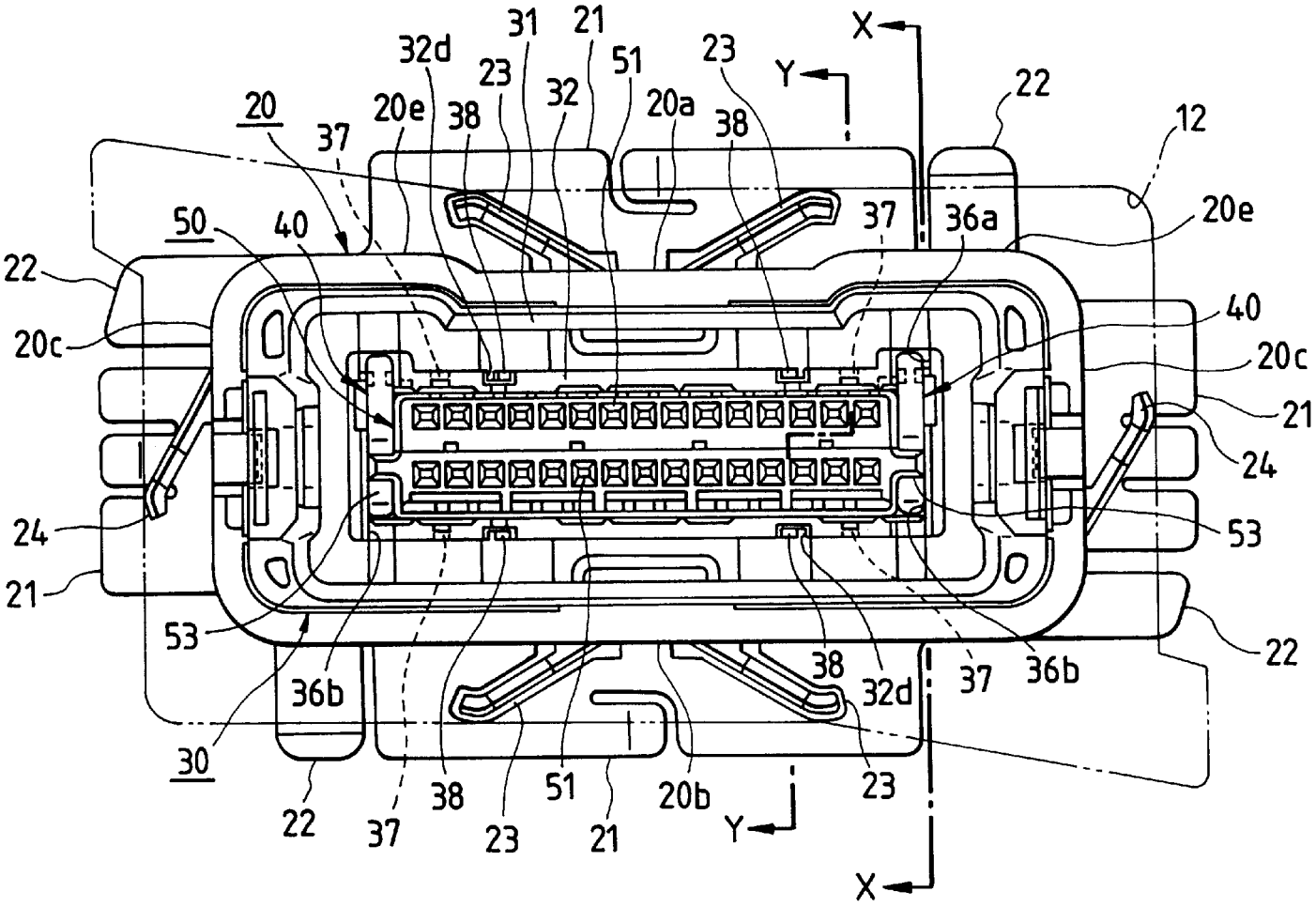
FIG. 4 is a front elevational view of the male connector housing side of male and female connector housings which make up the connector.

In accordance with the connector 10 in the above-described embodiment, when the wire harness W-side male connector housing 50 is mounted in the mounting hole 12 in the inner panel 11 by means of the holder 20, the male connector housing 50 is temporarily retained in the cover 30, and the cover 30 is set in the assembled state shown in FIG. 4 in which the cover 30 is temporarily retained in the holder 20, and the holder 20 is tilted. In this state, each front-side fixing plate portion 22 of the holder 20 is passed through the mounting hole 12 from the rear surface 11*b* side of the inner panel 11, and the holder is then rotated counterclockwise in FIG. 4, and the distal end of each front-side fixing plate portion 22 is retained at the front surface 11*a* side in the vicinity of the mounting hole 12 in the inner panel 11, thereby allowing the thus-subassembled connector 10 to be fixed as portions of the inner panel 11 surrounding the mounting hole 12 are clamped by the rear-side fixing plate portions 21 and the front-side fixing plate portions 22. At the time of this mounting operation, the aligning spring portions 23 and 24 on the upper and lower sides and left and right sides of the holder 20 abut against the peripheral edges of the mounting hole 12 in the inner panel 11, even if the holder 20 have moved vertically or horizontally inside the mounting hole 12, the holder 20 is aligned by the resiliency of the aligning spring portions 23 and 24 and is reliably fitted and fixed.

After the male connector housing 50 is mounted in the mounting hole 12 of the inner panel 11 by means of the holder 20, the female connector housing 60 is engaged with the male connector housing 50 which is in the state of waiting for engagement. A description will be given of the engagement of the male and female connector housings 50 and 60 with reference to FIGS. 3, 5, 6, and 12 to 14. As shown in FIGS. 3, 5, and 6, in the initial state of engagement between the two connector housings 50 and 60 in which the hood portion 61 of the female connector housing 60 is inserted between the outer wall 31 and the inner wall 32 of the cover 30, the state of waiting for engagement of the male connector housing 50 is reliably secured temporarily by the state of retention of the projection 25*a* of each flexible arm 25 of the holder 20 in the engaging hole 33*a* of each flexible retaining piece 33 of the cover 30, as well as by the state of retention of the pairs of upper and lower flexible arms 38 of the cover 30 and the pairs of other upper and lower stopper projections 56 of the male connector housing 50.

Namely, as shown in FIGS. 6 and 11A, in the state of waiting for engagement of the male connector housing 50, the reversely tapered surface 38*c* of the retaining portion 38*a* of each flexible arm 38 supported by the inner wall 32 of the cover 30 in the cantilevered manner and the tapered surface 56*b* on the rear side of the other stopper projection 56 of the male connector housing 50 are cause to abut against and are retained by each other, and even if each flexible arm 38 is slightly deflected, the tapered surfaces 38*c* and 56*b* are present in that direction. Therefore, the male connector housing 50 is prevented from falling rearwardly of the male connector housing 50, so that the force with which the male connector housing 50 is temporarily retained and held inside the cover 30 is sufficiently secured. Further, as shown in FIG. 6, since the front face 55*a* of each stopper projection 55 of the male connector housing 50 can be retained at the front wall portion 37*a* of each guide groove 37 of the inner wall 32 of the cover 30, the male connector housing 50 is prevented from jumping out forwardly from inside the cover 30. For these reasons, it is possible to reliably prevent the coming off of the cover 30 and the male connector housing 50 due to an external load force and the diagonally downward tilting of the male connector housing 50 inside the cover 30.

Then, when the two connector housings 50 and 60 begin to be engaged, the temporary-retention canceling projection 67 of the hood portion 61 of the female connector housing 60 abuts against the tapered surface 38*b* of the retaining portion 38*a* of each flexible arm 38, and each flexible arm 38 is deflected in the direction indicated by the arrow in FIG. 11A. As a result, the state of temporary retention between the reversely tapered surface 38*c* of the retaining portion 38*a* of each flexible arm 38 of the cover 30 and the tapered surface 56*b* on the rear side of the other stopper projection 56 of the male connector housing 50 is canceled, so that the male connector housing 50 is capable of being slid in the rearward direction inside the inner wall 32 of the cover 30. During this sliding, since each stopper projection 55 of the male connector housing 50 slides along each guide groove 37 of the inner wall 32 of the cover 30, the male connector housing 50 moves smoothly in the rearward direction inside the cover 30 without rattling in the horizontal direction and in the vertical direction.

Figure 12A:
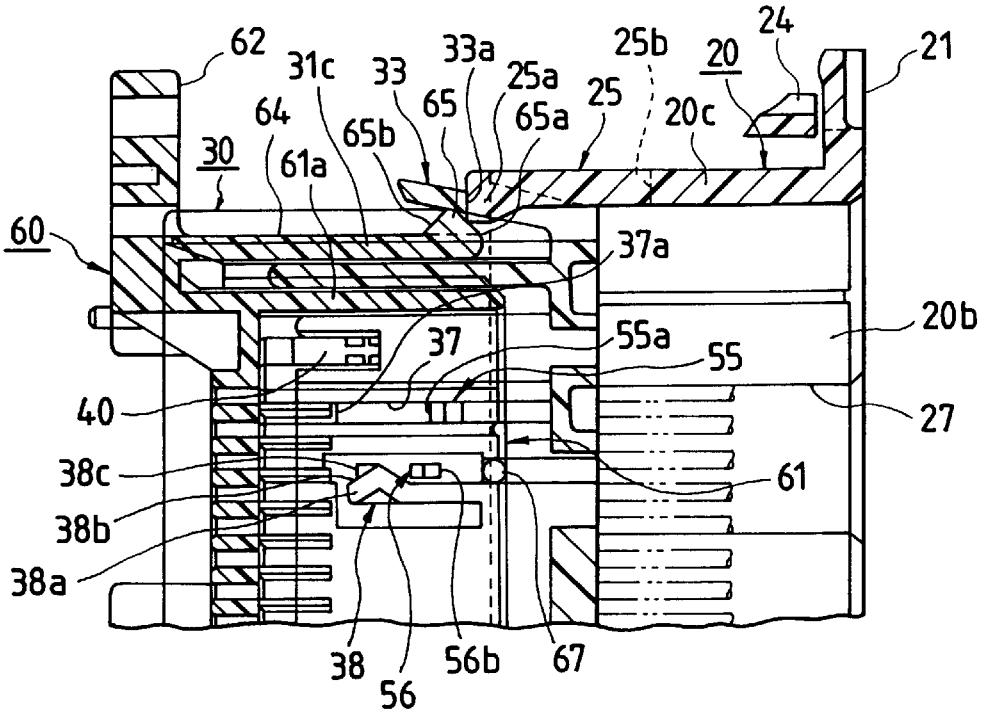
FIG. 12A is a partial cross-sectional view illustrating a state in which the connector is in the course of being engaged.
Figure 13:
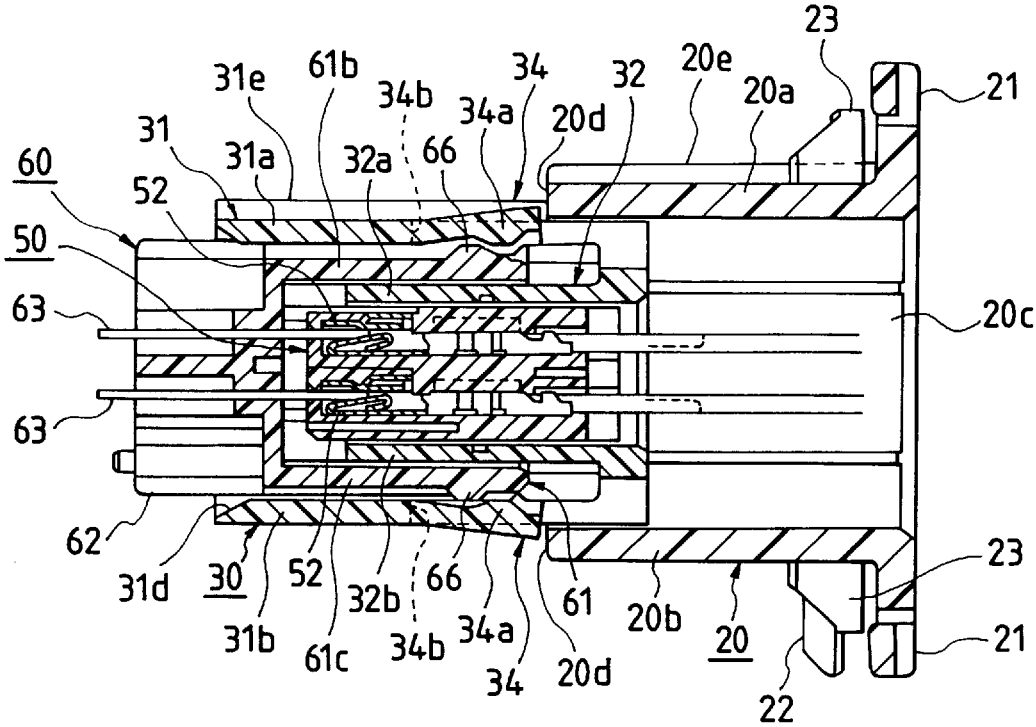
FIG. 13 is a longitudinal sectional view illustrating the state in which the connector is in the course of being engaged.

Next, as shown in FIG. 12A, in the course of engagement between the two connector housings 50 and 60, each flexible retaining piece 33 of the cover 30 is resiliently deformed in the outward direction due to the pressing force of the projection 65 of each flexible arm 64 of the female connector housing 60, and the engaging hole 33*a* of each flexible retaining piece 33 of the cover 30 abuts against the distal end face of each flexible arm 25 of the holder 20, so that the state of temporary retention of the projection 25*a* of each flexible arm 25 of the holder 20 in the engaging hole 33*a* of each flexible retaining piece 33 of the cover is maintained more reliably. At the same time, as shown in FIG. 13, each projection 66 of the female connector housing 60 rides over the inner-side projection 34*a* of each flexible stopper arm 34 of the cover 30 and causes each stopper arm 34 to become resiliently deformed in the outward direction, and the distal end of each flexible stopper arm 34 of the cover 30 abuts against the front end portion 20*d* of the holder 20, thereby reliably preventing the cover 30 from moving in the rearward direction inside the holder 20.

Figure 12B:
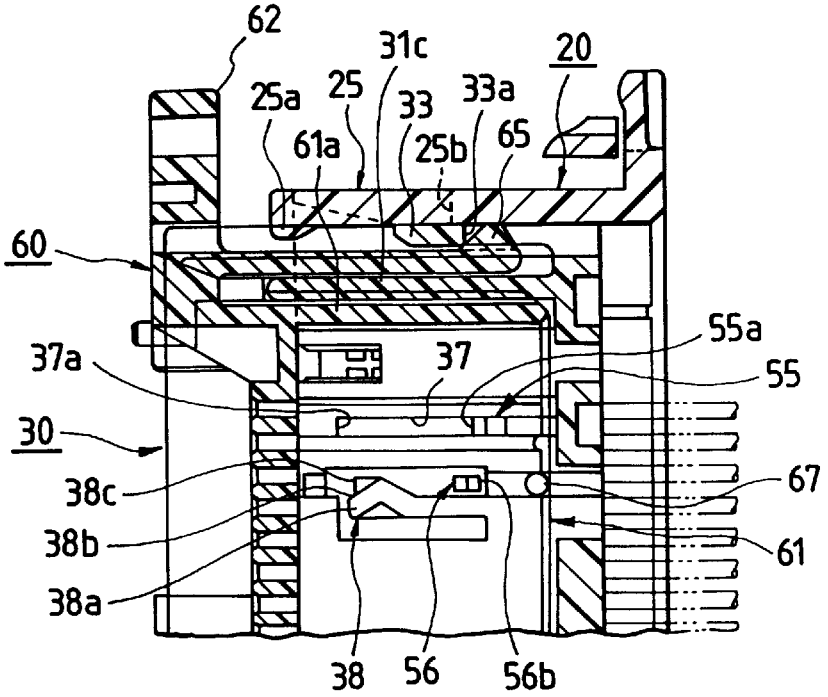
FIG. 12B is a partial cross-sectional view illustrating a state of completion of the engagement of the connector.
Figure 14:
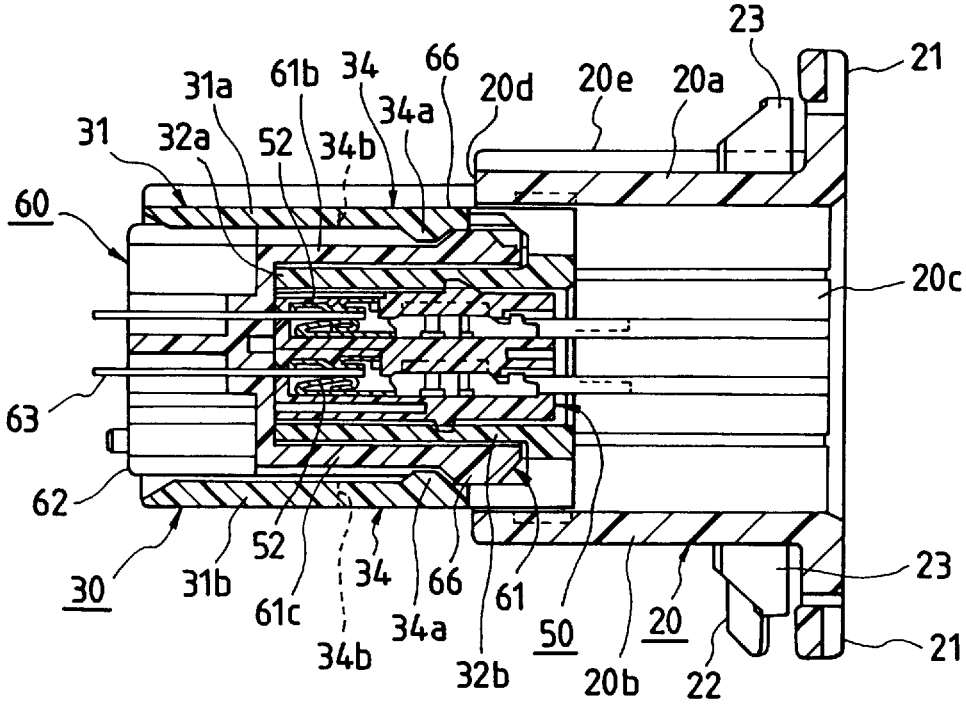
FIG. 14 is a longitudinal sectional view illustrating the engaged state of the connector.
Figure 18:
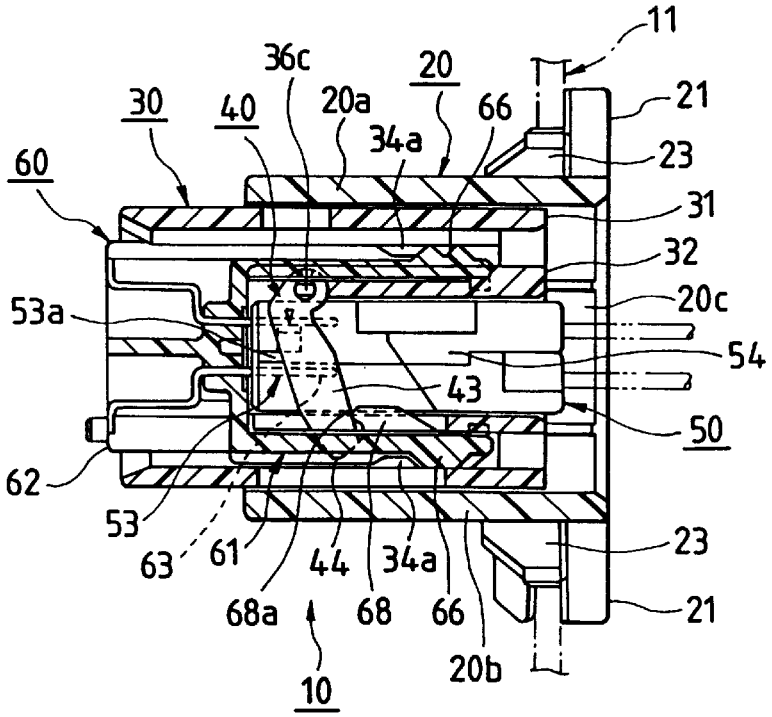
FIG. 18 is a longitudinal sectional view illustrating a state in which the two connector housings have been slid in the rearward direction to effect alignment upon completion of the engagement of the connector.
Figure 19:
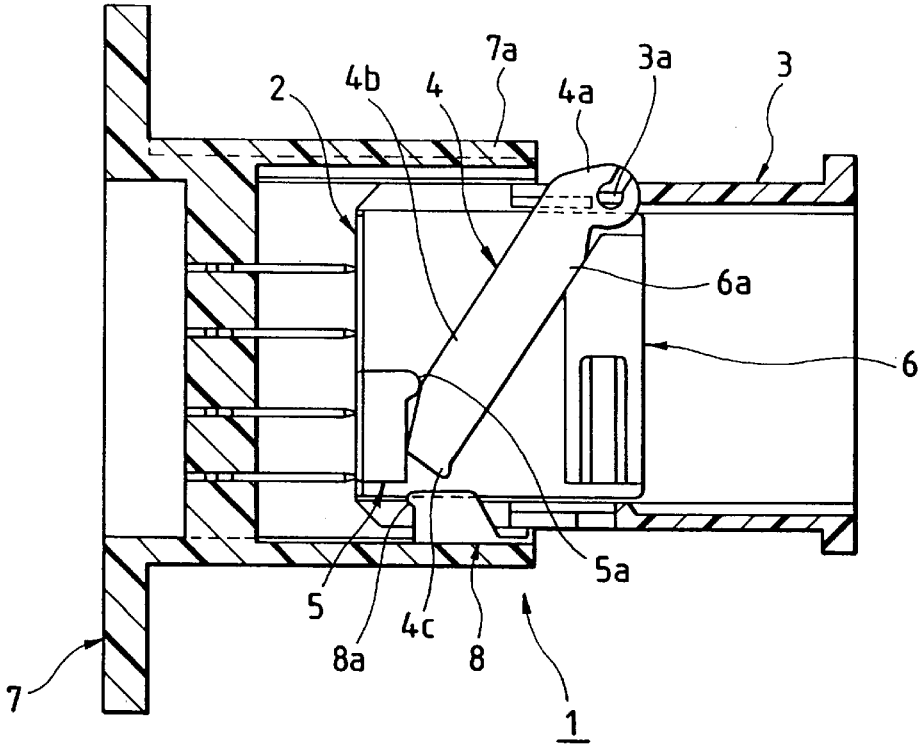
FIG. 19 RELATED ART
FIG. 19 is a longitudinal sectional view immediately before engagement of the related connector.
Figure 20:
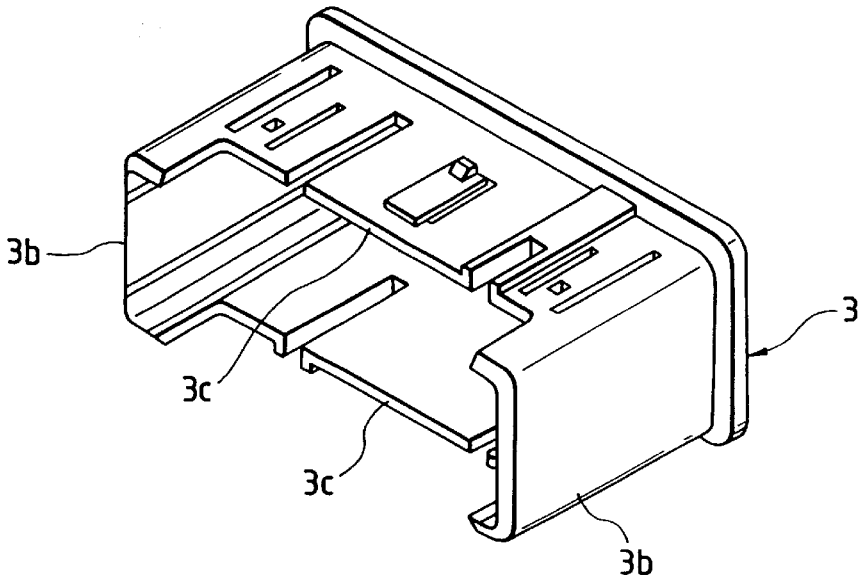
FIG. 20 RELATED ART
FIG. 20 is a perspective view of a slide cover used in the related connector.

Then, as shown in FIG. 12B, when the engagement of the two connector housings 50 and 60 is completed, each projection 65 of the female connector housing 60 enters the engaging hole 33*a* of each flexible retaining piece 33 of the of the cover 30. In addition, as shown in FIG. 14, since each projection 66 of the female connector housing 60 rides over the inner-side projection 34*a* of each flexible stopper arm 34 of the cover 30, each stopper arm 34 resumes its original state. For these reasons, the two connector housings 50 and 60 whose engagement has been completed are both capable of sliding in the rearward direction inside the cover 30, as shown in FIG. 18. During this sliding, since the stopper projections 35*a* and 35*b* of the cover 30 slide along the guide grooves 26 and 27 of the holder 20, the cover 30 smoothly moves in the rearward direction inside the holder 20 without rattling in the horizontal direction and in the vertical direction.

Figure 15:
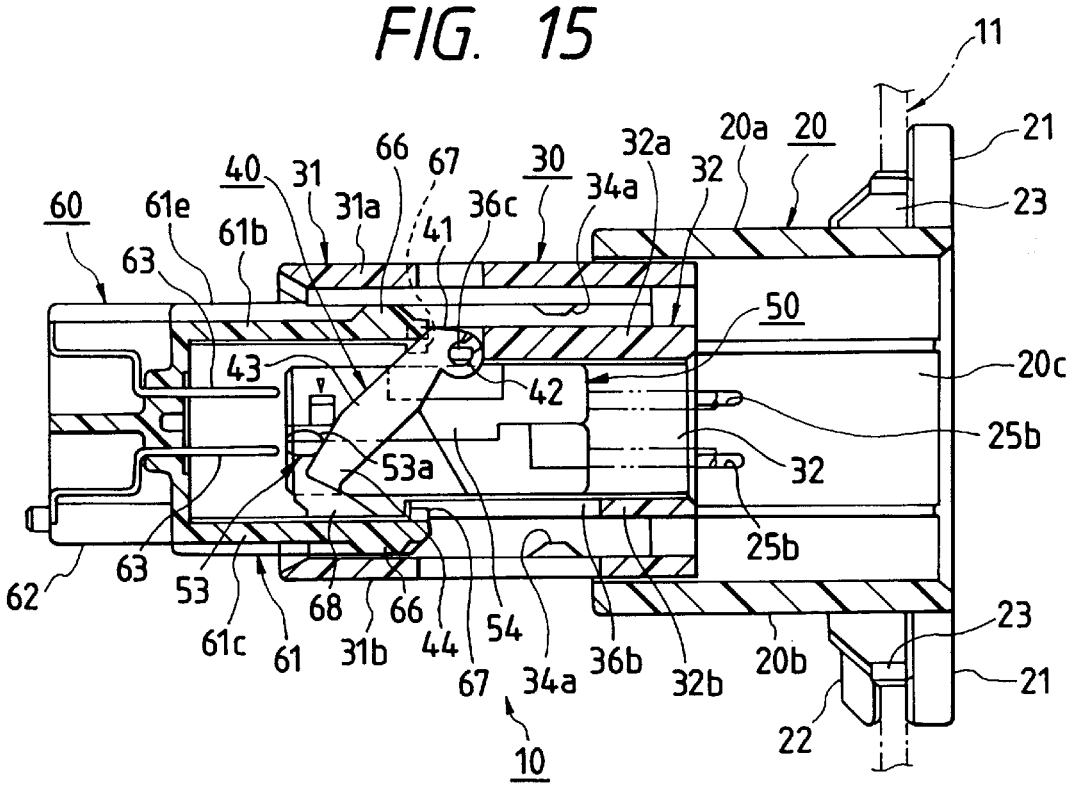
FIG. 15 is a longitudinal sectional view illustrating the state before the engagement of the connector.
Figure 16:
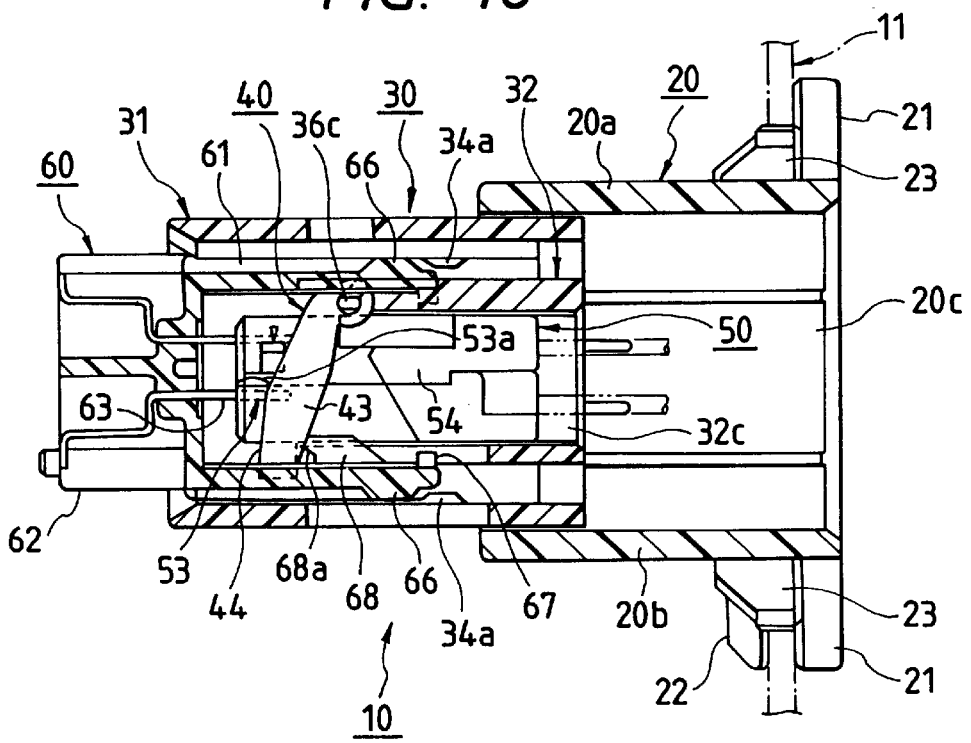
FIG. 16 is a longitudinal sectional view illustrating the state in which the connector is in the course of being engaged.
Figure 17:
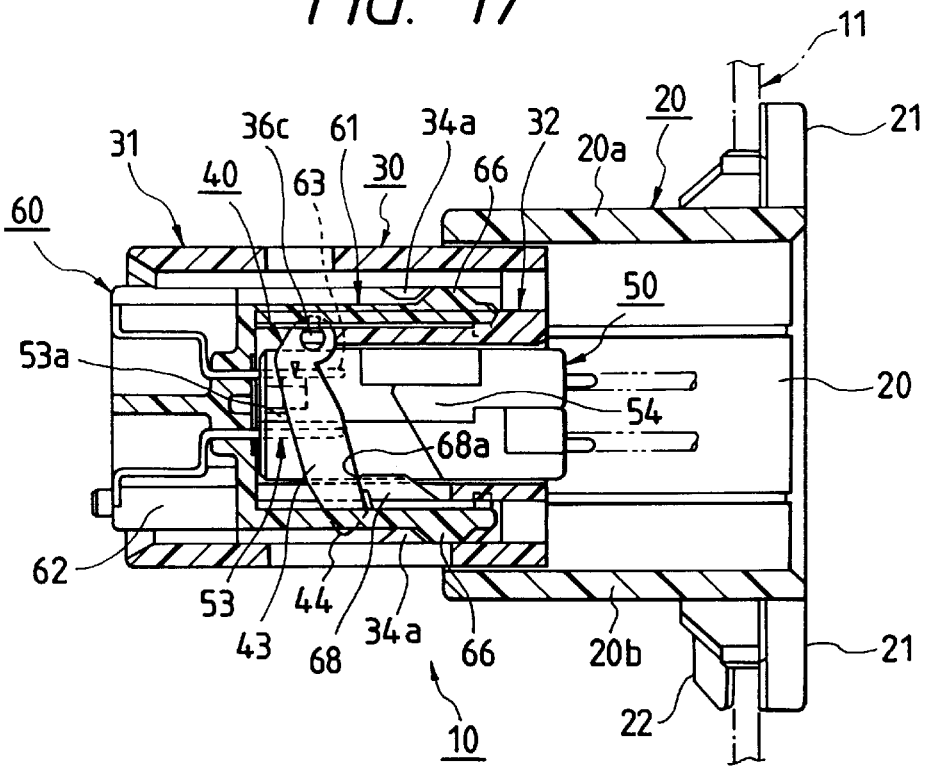
FIG. 17 is a longitudinal sectional view illustrating the state of completion of the engagement of the connector.

A description will be given of the process from the initial state of engagement until the completed state of engagement between the two connector housings 50 and 60 in terms of the relationship with the levers 40. As shown in FIG. 15, if the hood portion 61 of the female connector housing 60 is inserted between the outer wall 31 and the inner wall 32 of the cover 30, and the female connector housing 60 is pushed in the engaging direction of the two connector housings 50 and 60, the distal end portion 44 of the lever 40 abuts against the projection 68*a* for the lever fulcrum of the rib 68 inside the hood portion 61 of the female connector housing 60, and the lever 40 begins to rotate. Then, as shown in FIG. 17, if the female connector housing 60 is further pushed in the engaging direction, the hood portion 61 of the female connector housing 60 is pulled in between the outer wall 31 and the inner wall 32 of the cover 30 through the leverage of the lever 40 (the action of the lever in which the supporting shaft 36*c* for rotatably supporting the proximal end portion 41 of the lever 40 serves as the point of force application, the circular arc-shaped surface 53*a* of the guide portion 53 of the male connector housing 50 serves as the point of application, and the projection 68*a* of the rib 68 of the female connector housing 60 serves as the fulcrum), thereby allowing the two connector housings 50 and 60 to engage each other. Consequently, by virtue of the leverage of the levers 40 the operation of engaging the two connector housings 50 and 60 can be performed easily by merely sliding the female connector housing 60 in the engaging direction with a small manipulating force.

Thus, since each stopper projection 55 of the male connector housing 50 is arranged to be capable of sliding in and to be prevented from coming off each guide groove 37 of the inner wall 32 of the cover 30, and the reversely tapered surface 38*c* of the retaining portion 38*a* of each flexible arm 38 of the cover 30 and the rear-side tapered surface 56*b* of the other stopper projection 56 of the male connector housing 50 are arranged to be capable of being retained by and disengaged from each other, it is possible to improve the force with which male connector housing 50 is temporarily retained and held in the cover 30 until the completion of engagement between the male and female connector housings 50 and 60 as well as the operating efficiency for canceling the temporary retention. At the same time, it is possible to reliably prevent the diagonally downward tilting of the male connector housing 50. In particular, due to the deflectional deformation of each flexible arm 38 of the cover 30, the male connector housing 50 is able to constantly maintain the same temporarily retained state at the time of engagement and disengagement of the male and female connector housings 50 and 60. In addition, until the engagement of the male and female connector housings 50 and 60 is completed, the temporarily retained state of the cover 30 with respect to the holder 20 can be reliably maintained by each flexible retaining piece 33 and the flexible stopper arm 34 of the holder 30 which are operated by the projections 65 and 66 of the female connector housing 60. For these reasons, it is possible to prevent the faulty engagement or incomplete engagement between the two connector housings 50 and 60, and the two connector housings 50 and 60 can be engaged with each other easily and reliably.

As described above, in accordance with the present invention, it is possible to sufficiently secure the force with which one connector housing is temporarily retained and held in the cover until the completion of engagement between the male and female connector housings by virtue of the guide grooves of the cover and the retaining portions of the flexible arms and the respective stopper projections of one connector housing. As a result, it is possible to reliably prevent the coming off of the cover and one connector housing due to an external load force and the diagonally downward tilting of one connector housing inside the cover, and it is possible to prevent the faulty engagement or incomplete engagement between the two connector housings, making it possible to engage the two connector housings with each other easily and reliably.

What is claimed is:

1. An electrical, connector, comprising:

a first connector housing;

a second connector housing engageable with the first connector housing;

a cover having an inner wall for accommodating the first connector housing in a state of waiting for engagement so as to be reciprocatingly slidable;

a lever rotatably supported in the cover, the lever having a proximal end portion which is rotated by a reciprocal motion of the first connector housing;

a guide groove formed in said inner wall of the cover;

a flexible arm provided on the inner wall of the cover, the flexible arm having a retaining portion at a distal end thereof for temporarily retaining the first connector housing in said cover in the state of waiting for engagement inside the cover;

a first stopper projection slid in the guide groove, the first stopper projection being provided on the first connector housing at a position opposing the guide groove;

a second stopper projection provided on the first connector housing at a position opposing the retaining portion of the flexible arm, the second stopper projection being temporarily retained by the retaining portion of the flexible arm; and tapered surfaces respectively formed on the retaining portion of the flexible arm and the second stopper projection at mutually opposing positions thereof, the tapered surfaces of said flexible arm and said second stopper projection being arranged to retain each other.

2. The connector of claim 1, wherein an intermediate portion of the lever is linked to a point of action portion of the first connector housing, and a distal end portion of the lever is engageable with an engaging portion of the second connector housing when the first connector housing and the second connector housing are engaged with each other.

3. The connector of claim 1, wherein the cover completely envelops the first connector housing in the state of waiting for engagement.

* * * * *